United States Patent [19]

Thompson

[11] Patent Number: 4,762,240

[45] Date of Patent: Aug. 9, 1988

[54] ARTICULATING CRANE

[75] Inventor: George J. Thompson, Ocean Springs, Miss.

[73] Assignee: Paceco, Inc., Gulfport, Miss.

[21] Appl. No.: 5,203

[22] Filed: Jan. 20, 1987

[51] Int. Cl.[4] ..... B66C 23/42

[52] U.S. Cl. ..... 212/187; 212/219; 212/262

[58] Field of Search ..... 212/182, 187, 188, 219, 212/222, 262

[56] References Cited

U.S. PATENT DOCUMENTS

| | | | |
|---|---|---|---|
| 2,366,574 | 1/1945 | Taylor | 212/262 |
| 3,170,574 | 2/1965 | Wilkinson | 212/188 |
| 3,325,018 | 6/1967 | Wright | 212/187 |
| 3,370,717 | 2/1968 | Reapsummer | 212/188 |
| 3,804,264 | 4/1974 | Hedeen et al. | 212/222 |
| 4,403,704 | 9/1983 | Makino | 212/187 |
| 4,527,698 | 7/1985 | Nishihata et al. | 212/262 |

FOREIGN PATENT DOCUMENTS

| | | | |
|---|---|---|---|
| 691141 | 7/1964 | Canada | 212/222 |
| 501510 | 6/1930 | Fed. Rep. of Germany | 212/182 |
| 620024 | 9/1935 | Fed. Rep. of Germany | 212/182 |
| 1530688 | 6/1968 | France | 212/182 |

*Primary Examiner*—Joseph F. Peters, Jr.
*Assistant Examiner*—Thomas J. Brahan
*Attorney, Agent, or Firm*—Bruce & McCoy

[57] ABSTRACT

An articulating shore-side gantry crane having inboard and outboard boom sections which in the stowed position have the inboard section projecting upwards at an angle approaching the vertical and the outboard boom section supported in a substantially horizontal position attached to the end of the inboard boom section.

4 Claims, 4 Drawing Sheets

FIGURE 6
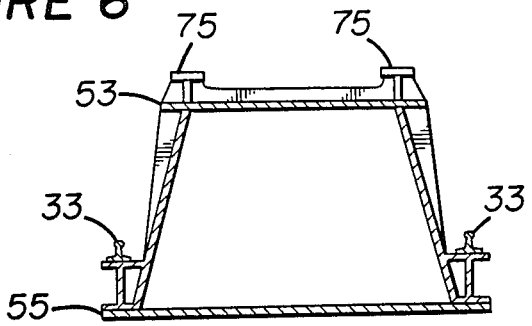
FIGURE 5
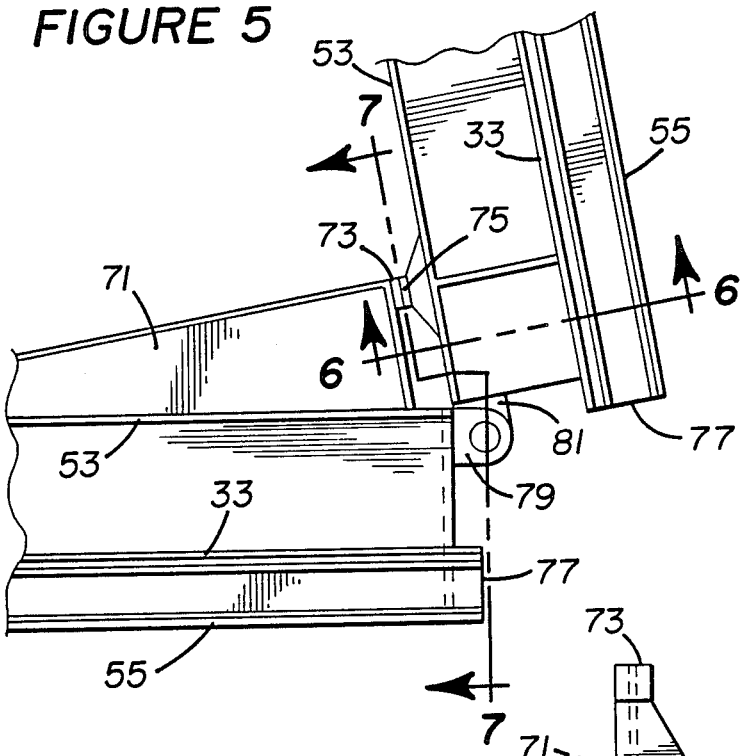
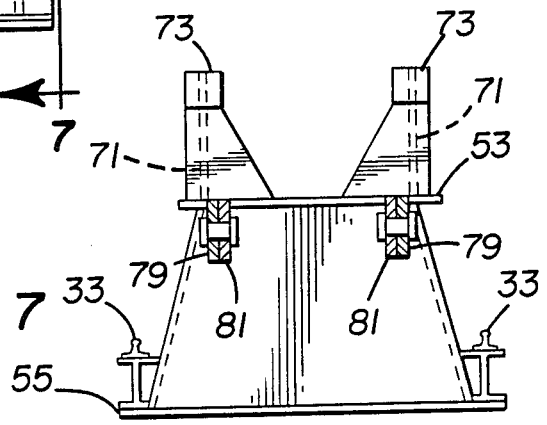
FIGURE 7

ARTICULATING CRANE

BACKGROUND OF THE INVENTION

1. Field of the Invention

The present invention relates to shore-side gantry cranes and more particularly to an improved articulated crane which in the stowed position with the gantry lifted to prevent interference with the movement of ships along the shore-side, the end of the gantry boom is disposed in an articulated position to lower its overall profile.

2. Description of the Prior Art

The present invention is an improvement upon a prior art articulating crane developed by the assignee of the prior art crane. That crane is described in U.S. Pat. No. 3,325,018 to Lawrence A. Wright for ARTICULATING CRANE, issued June 13, 1967. The disclosure of that patent defines the environment of the invention and its usefulness and it is therefore incorporated herein by reference.

Cranes used for unloading docked ships are usually mounted on tracks which run along the edge of the dock to permit the crane to be moved from ship to ship or to adjust to the ships variable docking positions. Cranes used for unloading cargo containers generally have the horizontal extension or boom called a gantry which projects over and across the deck of a ship. In order to position the boom across the ship or to remove it, the boom must be capable of movement in a vertical plate to avoid interfering with the rigging or superstructure of the ship. It therefore cannot be swung into position by rotating about a vertical axis. In order to effect the vertical movement of the horizontally extending boom, it generally must be rotated about its inboard end where it is hinged to the supporting structure.

In harbor areas there are often minimum height limitations for apparatus which extend out over the water when not in use to prevent such structures from interfering with passing or docking ships. On the other hand, there are sometimes maximum height limitations, if there are nearby airports, which must be observed.

With a large crane having a long boom, such limitations prevent the boom from being raised to a vertical position for storage in its fully extended position; even during movement to clear a ships rigging or superstructure. Thus, an arrangement cannot be used which causes the boom to swing horizontally or which permits it to swing straight up. Likewise it cannot be a structure which extends out over the water during storage, unless the projecting portion is above a minimum height, and, in order to be competitive cost-wise, the crane should not need to have any capability of rotating about a vertical axis. In essence, the boom must retract in a vertical plane while not exceeding a maximum height limitation or have over-the-water projecting portions depending below a minimum height limitation when retracted. This presents a difficult problem in providing an articulated crane which satisfies all of these conditions, but it will be observed that the present invention is a new and novel structure which meets and fulfills all of the requirements of the problem.

SUMMARY OF THE INVENTION

The present invention is a crane comprising a supporting structure having an inboard boom section with the inboard end thereof pivotally secured to the supporting structure by first hinge means which has a horizontal axis of rotation and is disposed perpendicular to the longitudinal axis of the boom. An outboard boom section, having a second hinge means with an axis of rotation parallel to the first hinge means, pivotally secures the outboard boom section to the inboard boom section. Both of the boom sections are capable of pivoting upward to raised positions. When the outboard boom section is raised to an upward projecting position limit when the inboard boom section is disposed in its lowered outward projecting horizontal operating position, the outboard boom section has its center of gravity located ouboard of its hinge connection to the inboard boom section. A means is provided for rotating the outboard boom section about its hinge connection to the inboard boom section to the upward projecting position limit. A means is also provided for rotating the inboard boom section about its inboard end, when the outboard boom section is disposed in its upward projecting stowed position, to a raised position limit or stowed position approaching the vertical with the center of gravity of said combination of said booms being located outboard of the pivot connection of the inboard boom with the supporting structure. Means are provided for lowering said inboard and outboard boom sections with the outboard boom section disposed in its stowed position until said inboard boom section has been lowered to its horizontal operating position and then lowering the outboard boom section until it is also in a horizontal operating position.

OBJECTS OF THE INVENTION

It is therefore an important object of the present invention to provide a gantry crane with a boom which can be rotated in a vertical plane from its working position to a retracted position which does not extend out over the water.

It is another object of the present invention to provide a crane which has a horizontal boom which when retracted to its stored position does not extend above a maximum height limitation.

It is a further object of the present invention to provide a crane which does not penetrate above a maximum height limitation during operation or during movement from its working to its retracted position.

It is yet another object of the present invention to provide a crane which utilizes only its cargo hoist machinery for moving the horizontal boom from its working position to its retracted position.

Other objects ad advantages of the present invention will become apparent when the crane is considered in conjunction with the accompanying drawings.

DESCRIPTION OF THE DRAWINGS

FIG. 5 is a partial elevation of the hinge stops;

FIG. 6 is a section of FIG. 1 taken along lines 6—6 thereof; and

FIG. 7 is a section of FIG. 4 taken along lines 7—7 thereof.

DESCRIPTION OF THE PREFERRED EMBODIMENT

Figure 1:
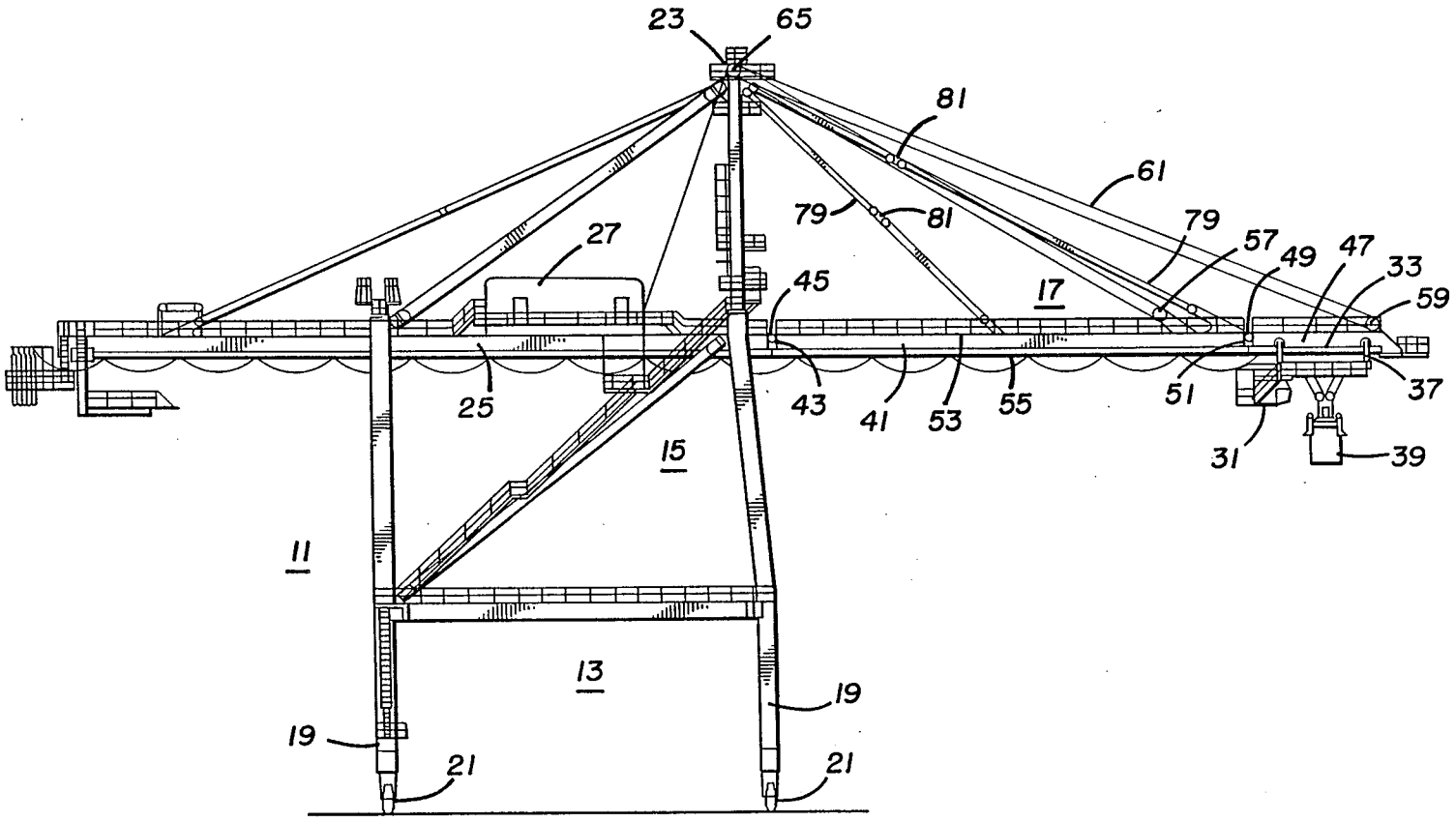
FIG. 1 is a side elevation of a preferred embodiment of the crane that is contemplated by the present invention with its gantry boom in the operating position.
Figure 2:
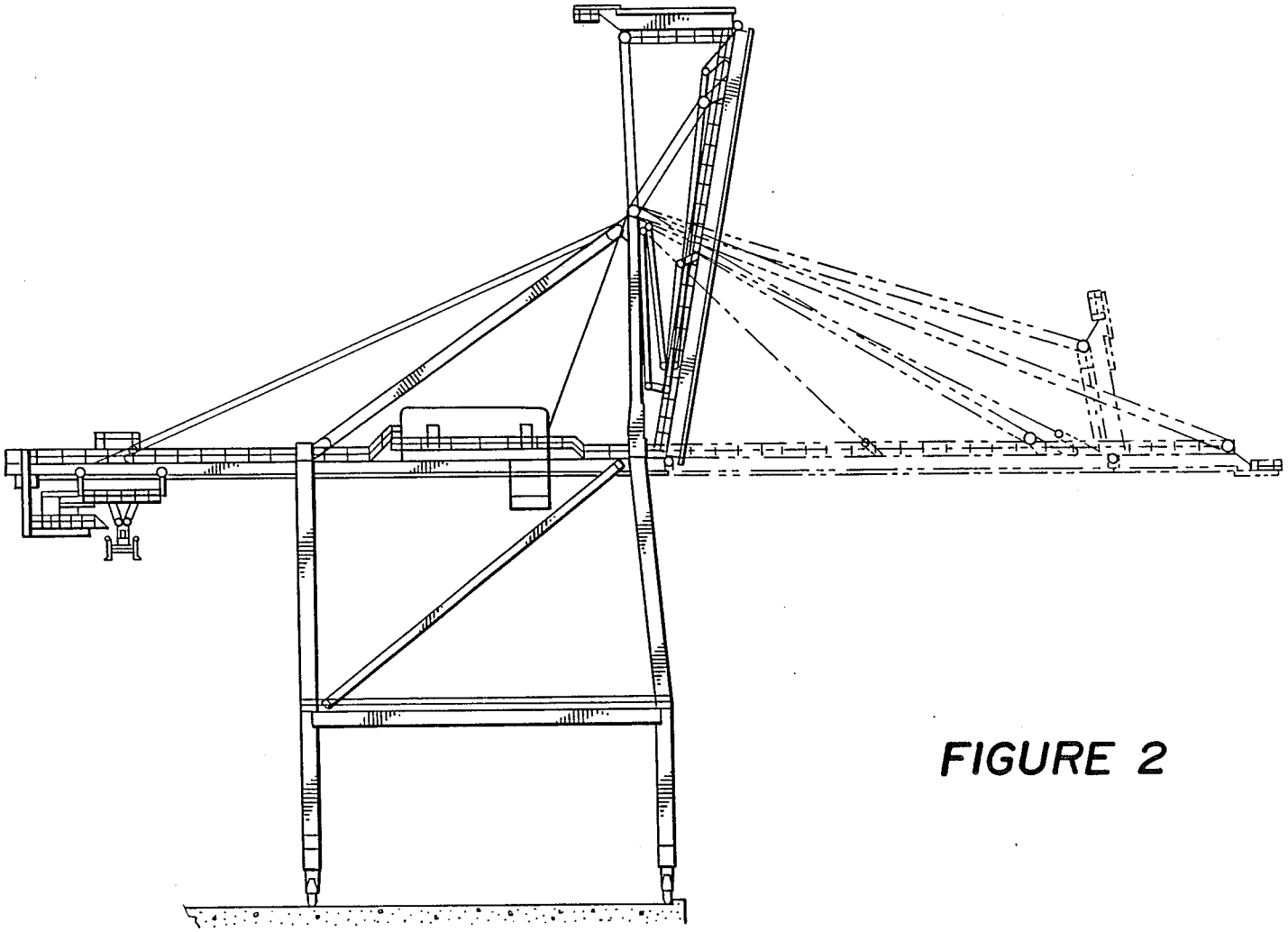
FIG. 2 is a side elevation of the crane in its retracted position also showing the gantry boom in its first stage of retraction in phantom lines.
Figure 3:
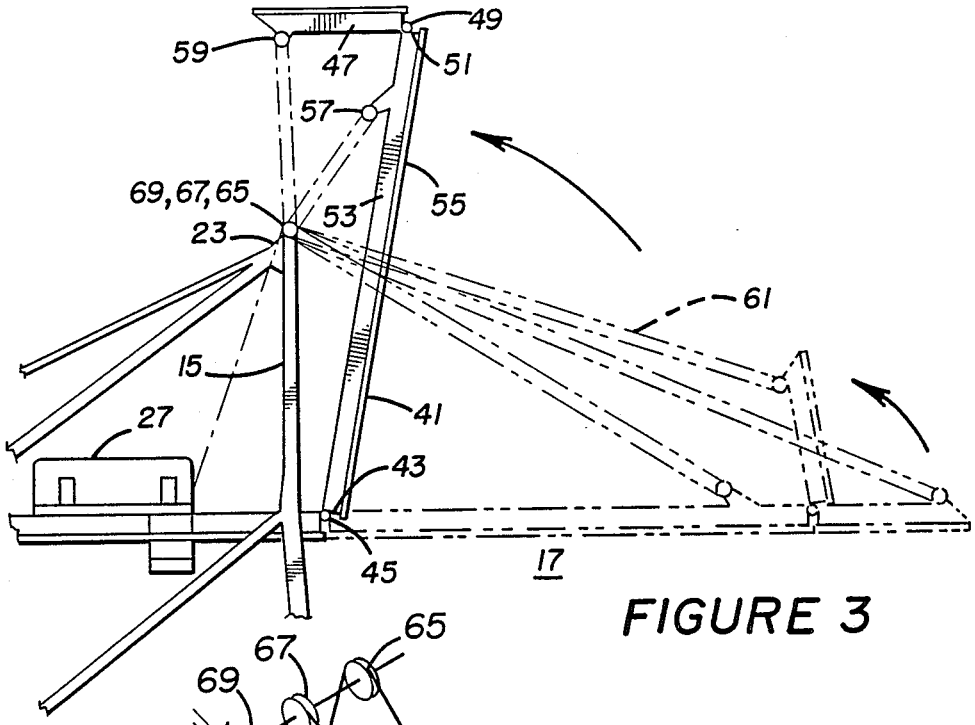
FIG. 3 is a partial side elevation schematic showing the crane retraction in stages.

Reference is made to the drawings for a detailed description of a preferred embodiment of the present invention. Illustrated in FIG. 1 is a shoreside movable crane comprising a supporting structure 11 having two vertical sections; a base portion 13 and a superstructure 15. A horizontally extending gantry boom 17 is supported by the superstructure. The base portion has four vertical standing legs 19 which support the superstructure portion. The legs of the base have wheel means or trolleys 21 located at their lower extremities which permit movement of the crane along tracks which are usually located parallel and adjacent the edge of the shipping docks. Although four legs are shown in the preferred embodiment, it is conceivable to use a tripod base with two legs on the boom side of the crane, which is nearest the edge of the dock, and a single supporting leg on the rearward track. However, to permit the crane to be constructed in the preferred embodiment as shown, four legs are utilized.

The superstructure portion 15 of the supporting structure is located above the base portion and rises to an apex 23 which is located within the plan of the base section to provide stability to the crane. In the preferred embodiment, a working platform or gantry 25 is supported by the structure and is located at an elevated position above the junction of the base portion with the superstructure approximately mid-way up the superstructure. The gantry 25 supports the machinery house 27 which contains the winches and hoist machinery for operating the crane. Flood lights 29 are arranged along the superstructure, the working platform, and the horizontally extending boom for lighting the work area.

A trolley mounted control cab 31 is suspended below the gantry on rails 33 which are disposed on opposite sides of the boom. A lifting spreader and headblock 35 are suspended from the trolley 37 adjacent the control cab 31 for lifting cargo containers 39 off of the dock or the ship and moving them to their destination.

The horizontally extending gantry boom 17 is comprised of two sections. The first is an inboard boom section 41, and it is pivotally secured at its inboard end 43 to the supporting structure by a first hinge means 45 having a horizontal axis of rotation disposed perpendicular to the longitudinal axis of the boom. The first hinge means is located at the upper structural edge of the inboard end of the boom and permits arcuate rotation of the inboard boom section in a vertical plane about its inboard end 41. The second section of the horizontally extending gantry boom 17 is an outboard boom section 47 which is secured to the inboard section 41 by a second hinge means 49 which has its axis of rotation parallel the axis of the first hinge means 45. The second hinge means is located at the upper structural edge of the outboard end 51 of the inboard boom section 41 and permits the outboard boom section 47 to rotate upward relative to the inboard section. Both of the boom sections have depth defined by the upper and lower structural edges 53, 55.

Means are supplied for rotating the outboard boom section 47 about its hinge connection 49 to the inboard boom section 41 to an upward projecting position limit or stowed position. Means are also supplied for rotating the inboard boom section 41, when the outboard boom section 49 is disposed on its upward projecting stowed position, to a raised position limit or stowed position approaching the vertical. In this stowed position, the center of gravity of the combination of the inboard and outboard boom sections is located outboard of the pivot connection 45 of the inboard boom section with the supporting structure. The means for rotating both the inboard and outboard boom sections also includes means for lowering the inboard and outboard boom sections with the outboard boom section disposed in its stowed position until the inboard boom section has been lowered to its horizontal operating position. Then, the outboard boom section is lowered until it is in a horizontal operating position.

The means for rotating the inboard and outboard boom sections and lowering the boom sections sequentially comprises a wire rope 57 and sheave mechanism having sheaves 57, 59 disposed proximate the ouboard ends of each of the boom sections and a wire rope loop 61 driven by a winch 63 in the machinery house 57 which picks up the outboard end of the outboard boom section first and raises it to its raised position during rotation of the booms before raising the inboard boom section. The mechanism also lowers the combination of booms with the outboard boom section stowed in its raised position until the inboard boom section has been rotated down to its horizontal operating position before the outboard boom section is permitted to rotate down to its horizontal operating position. The wire rope and sheave mechanism includes at least one wire rope reeved from the winch over at least one sheave 65 disposed proximate the top of the superstructure, around at least one of the sheaves disposed at the outboard ends of the inboard and outboard boom sections 57, 59, back around at least another sheave 67 disposed proximate the top of the superstructure, around at least the other sheave disposed at the outboard end of the other boom section, and back to the top of the superstructure where it is dead-ended 69. The winch of the boom hoist machinery takes in the end of the hoist rope and, since the outboard boom section is lighter and easier to lift than the inboard boom section, the rope pulls the outboard boom section into its raised stowed position against its position limit and then the continuous pulling on that reeving lifts the inboard boom section up against its stop limit. For safety, a double system is used. Two wire ropes are reeved in parallel so that if one of them breaks, the boom is still supported by the other one. These two wire ropes are driven by the same winch.

Figure 4:
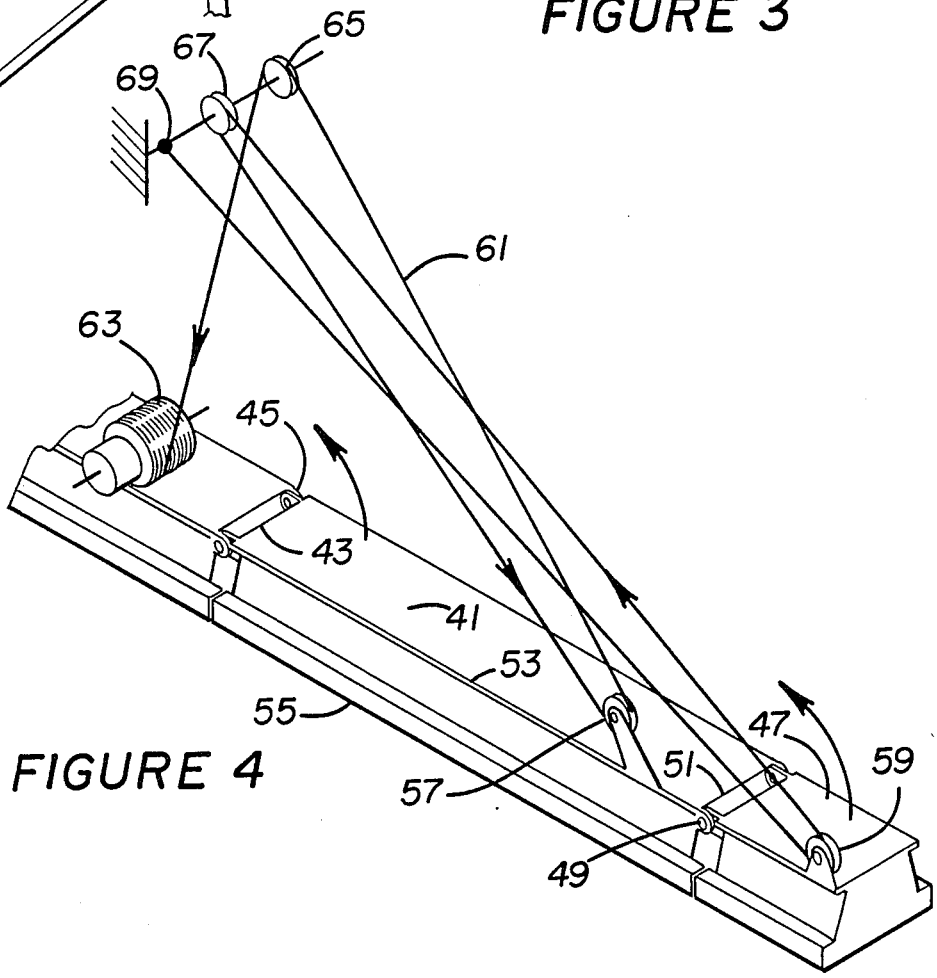
FIG. 4 is a perspective schematic of one half of the reeving system for articulating boom.

The inboard and outboard boom sections are provided with stop means which are positioned for stopping rotation of the boom sections about their hinges at the position limits. A first stowed position stop means is mounted on the adjacent ends of the inboard and outboard boom sections to prevent rotation of the outboard boom section, when it is being raised relative to the inboard boom section (when said inboard boom section is disposed in its lowered position) past a position where the center of gravity of the outboard boom section just approaches from the outboard direction a vertical plane through the axis of the hinge connection between the booms. The first stowed position stop means includes a brack 71 (see FIG. 4) secured to the outboard end of the inboard boom section which projects upward therefrom to engage the outboard boom section at a position outboard of the second hinge means when the outboard boom section is raised to its stowed position. The brace includes bearing pads 73 which engage similar stop pads 75 disposed on the upper surface of the outboard boom section structural edges which are aligned to meet the brace pads 73.

A second stowed position stop means is provided to prevent rotation of the inboard boom section, when it is being raised from its lowered position with the outboard boom section in its stowed position, past a position where the center of gravity of the combination of booms just approaches from the outboard direction a vertical plane through the axis of the hinge connection of the inboard boom section with its supporting structure. The second stowed position stop means also includes a brace secured to the superstructure which projects outboard therefrom to engage the inboard boom section at a position outboard of the first hinge means when the inboard boom section is raised to a stowed position. This stop means is similar in construction to the first stop means illustrated in FIG. 4.

The inboard and outboard boom sections have operating position stop means disposed at their adjacent lower structural edges to prevent downward rotation of the booms below a horizontal operating position. These stop means include abuttment pads 77 (see FIG. 4) disposed on the superstructure and on the inboard end of the inboard boom section below said first hinge means. Similar abuttment pads disposed on the adjacent ends of the inboard and outboard boom sections below said second hinge means.

The inboard boom section is supported by collapsible links 79 which are secured at one of their ends to a position proximate the top of the crane superstructure and at the other ends to the inboard boom section at midspan and at the outboard end thereof. These support links carry the weight of the inboard and outboard boom sections when the gantry boom is lowered to its horizontal operating position. As soon as the boom sections begin to rotate about their inboard hinge connections during raising, the links collapse at their intermediate hinges 81 due to their own weight.

Thus, it can be seen that a very simple gantry crane structure is provided which is self-articulating and requires no synchronized operation or control system. Simply by reeling in the boom hoist ropes in the sheave system, the outboard boom section first collapses to an upstanding limit and then continued hoisting on the wire ropes pulls both boom sections to their fully upraised retracted positions. No switching synchronizing, or control is necessary to effect the articulation of the booms except to pull on the hoist ropes. Lowering the booms is also self-effecting. The simplicity of the system is an essential characteristic of the invention providing safe, simple, operator foul-up proof operation.

It will be apparent from the foregoing description of the invention in its preferred form that it will fulfill all the objects attributable thereto, and while it has been illustrated and described in considerable detail, the protection is not to be limited to such details as have been set forth except as may be necessitated by the appended claims.

I claim:

1. A crane comprising a supporting structure, an inboard boom section having the inboard end thereof pivotally secured to said supporting structure by a first hinge means having a horizontal axis of rotation disposed perpendicular to the longitudinal axis of said boom, an outboard boom section having a second hinge means with an axis of rotation parallel to the first hinge means pivotally securing said outboard boom section to said inboard boom section, both of said booms being capable of pivoting upward to raised stowed positions, said outboard boom section having its center of gravity located outboard of its hinge connection to said inboard boom section when said outboard boom section is raised to an upward projecting position limit or stowed position and when said inboard boom section is disposed in its lowered outward projecting horizontal operating position, means for rotating said outboard boom section about its hinge connection to said inboard boom section to said upward projecting stowed position, and means for rotating said inboard boom section about its inboard end, when said outboard boom section is disposed in its said upward projecting stowed position, to a raised position limit or stowed position approaching the vertical with the center of gravity of said combination of said booms being located outboard of the pivot connection of said inboard boom section with said supporting structure, said means for rotating said boom sections also being formed for lowering said inboard and outboard boom sections with said outboard boom section disposed in its stowed position until said inboard boom section has been lowered to its horizontal operating position and then lowering said outboard boom section until it is in a horizontal operating position, and said means for rotating said inboard and outboard boom sections to the upward projecting stowed position and lowering said boom sections sequentially including a wire rope and sheave mechanism having sheaves disposed proximate the outboard ends of each of said boom sections and a continuous wire rope loop reeved through both of said sheaves at the outboard ends of said boom sections and driven by a winch which picks up the outboard end of said outboard boom section first by shortening of said rope and raises it to its raised position during rotation of said booms before further shortening of said rope by said winch raises the outboard end of said inboard boom section, and lengthening of said rope lowers the combination of booms with the outboard boom section stowed in its raised position until the inboard boom section has been rotated down to its horizontal operating position before said outboard boom section is rotated down to its horizontal operating position.

2. A crane comprising a supporting structure, an inboard boom section having the inboard end thereof pivotally secured to said supporting structure at an elevated location thereon for arcuate rotation in a vertical plane from a lowered horizontal operating position, an outboard boom section pivotally secured by its inboard end to the outboard end of said inboard boom section for movement in a vertical plane from its lowered horizontal operating position, a first stop means mounted on the adjacent ends of said inboard and outboard boom sections interacting to prevent rotation of said outboard boom section, when it is being raised relative to said inboard section to a stowed position, and when said inboard boom section is disposed in its lowered position, past a position when said outboard boom section is in the stowed position where the center of gravity of said outboard boom section just approaches from the outboard direction a vertical plane through the axis of the hinge connection between said booms, a second stop means mounted on said supporting structure and said inboard boom section interacting to prevent rotation of said inboard boom section, when it is being raised to a stowed position from its lowered position with the outboard boom in its raised position, past a position when said inboard boom section is in the stowed position where the center of gravity of said combination of booms just approaches from the outboard direction a vertical plane through the axis of the hinge connection of said inboard boom with said supporting structure, and means for raising and lowering said booms in a vertical plane whereby said booms can be articulated from a horizontal operating position to a raised stowed position where said inboard boom section is supported in an upraised position approaching the vertical and said outboard boom section is supported in a substantially horizontal inverted position and said booms can be lowered to their horizontal operating position sequentially with the outboard boom section in its stowed position until the inboard boom section has been lowered to its horizontal operating position before said outboard boom section is rotated down to its horizontal operating position, said means for raising and lowering said boom sections including a wire rope and sheave mechanism having sheaves disposed proximate the outboard ends of each of said boom sections and a winch driven continuous wire rope loop which is reeved through both of the sheaves disposed on the outboard ends of said boom sections, said means picking up the outboard end of said outboard boom section first by shortening of said rope and raising said outboard boom section to its raised position during rotation of said booms before further shortening of said rope by said winch raises the outboard end of said inboard boom section, and lengthening of said rope lowers the combination of booms with the outboard boom section stowed in its raised position until the inboard boom section has been rotated down to its horizontal operating position before said outboard boom section is rotated down to its horizontal operating position.

3. A crane comprising a supporting structure having an inboard boom section pivotally secured thereto and an outboard boom section pivotally secured to the outboard end of said inboard boom section, said boom sections having depth defined by upper and lower structural edges, said supporting structure having a base portion, including at least four vertical legs with wheeled means at the lower extremities thereof for permitting movement of the crane along tracks, and a superstructure portion extending upward relative to and above said base portion and having said inboard boom section secured thereto, said inboard boom section being secured to said superstructure by a first hinge means having a horizontal axis of rotation perpendicular to the longitudinal axis of said boom and being located at the upper structural edge of the inboard end of said boom, said outboard boom section having a second hinge means with an axis of rotation parallel the axis of said first hinge means also located at and secured to the upper adjacent structural edges of the inboard and outboard boom sections and pivotally securing said outboard boom section to said inboard boom section, said inboard and outboard boom sections having operating position stop means disposed at their adjacent lower structural edges to prevent downward rotation of said booms below a horizontal operating position, a first stowed position stop means mounted on the adjacent ends of said inboard and outboard boom sections to prevent rotation of said outboard boom section, when it is being raised relative to said inboard section and when said inboard boom section is disposed in its lowered position, past a position where the center of gravity of said outboard boom section just approaces from the outboard direction a vertical plane through the axis of the hinge connection between said booms, a second stowed position stop means to prevent rotation of said inboard boom section, when it is being raised from its lowered position with the outboard boom section in its stowed position, past a position where the center of gravity of said combination of booms just approaches from outboard direction a vertical plane through the axis of the hinge connection of said inboard boom with said supporting structure, and means for raising and lowering said booms in a vertical plane whereby said booms can be articulated from a substantially horizontal operating position to a stowed position where said inboard boom section is supported in a raised position approaching the vertical and said outboard boom section is supported in a substantially horizontal inverted position and said booms can be lowered to their horizontal operating position sequentially with the outboard boom section in its stowed position until the inboard boom section has been lowered to its horizontal operating position before said outboard boom section is rotated down to its horizontal operating position, said means for raising and lowering said boom sections including a wire rope and sheave mechanism having sheaves disposed proximate the outboard ends of each of said boom sections and a winch driven continuous wire rope loop which is reeved through both of the sheaves disposed on the outboard ends of said boom sections, said wire rope and sheave mechanism including at least one wire rope reeved from the winch over at least one sheave disposed proximate the top of said superstructure, around at least one of the sheaves disposed at the outboard ends of the inboard and outboard boom sections, back around at least another sheave disposed proximate the top of said superstructure, around at least the other sheave disposed at the outboard end of the other boom section, and back a dead end on the superstructure.

4. The crane of claim 3 wherein said inboard and outboard boom sections are supported by collapsible links secured at one of their ends proximate the top of the crane superstructure and at the other of their ends proximate the outboard ends of the inboard and outboard boom sections respectively, said operating position stop means includes abutment pads disposed on said superstructure and the inboard end of said inboard boom section below said first hinge means, and abutment pads disposed on the adjacent ends of said inboard and outboard boom sections below said second hinge means, said first stowed position stop means includes a brace secured to the outboard end of said inboard boom section and which projects upward therefrom to engage said outboard boom section at a position outboard of said second hinge means when said outboard boom section is raised to its stowed position, and said second stowed position stop means includes a brace secured to said superstructure and which projects outboard therefrom to engage said inboard boom section at a position outboard of said first hinge means when said inboard boom section is raised to its stowed position.

* * * * *